United States Patent [19]

Baranaev et al.

[11] Patent Number: 4,470,325

[45] Date of Patent: Sep. 11, 1984

[54] GEAR DRIVE OF FORGING MACHINE

[76] Inventors: Mikhail I. Baranaev, Kombainovaya ulitsa, 36, kv. 11b; Oleg I. Njunko, ulitsa Stankozavodskaya, 9, kv. 12; Evgeny A. Savinov, ulitsa Internatsionalnaya, 3, korpus 2, kv. 47; Vladimir G. Voronov, ulitsa Oktyabrskaya, 10/13, kv. 13, all of Ryazan, U.S.S.R.

[21] Appl. No.: 413,355

[22] PCT Filed: Dec. 24, 1980

[86] PCT No.: PCT/SU80/00209

§ 371 Date: Aug. 19, 1982

§ 102(e) Date: Aug. 19, 1982

[87] PCT Pub. No.: WO82/02157

PCT Pub. Date: Jul. 8, 1982

[51] Int. Cl.[3] ..... F16H 37/06; F16H 1/12; F16H 1/20

[52] U.S. Cl. ..... 74/665 GA; 74/421 A; 74/421 R; 72/449

[58] Field of Search ..... 74/413, 421 R, 421 A, 74/665 GA; 403/368, 370, 371, 374; 72/402, 403, 449

[56] References Cited

U.S. PATENT DOCUMENTS

| | | | |
|---|---|---|---|
| 733,719 | 7/1903 | Kehl et al. | 74/665 GA |
| 2,073,348 | 3/1937 | Merkle | 74/421 A |
| 2,299,268 | 10/1942 | Fisher | 74/413 X |
| 2,642,756 | 6/1953 | Cummings | 74/665 GA |
| 3,246,673 | 4/1966 | Feud | 74/665 GA X |

FOREIGN PATENT DOCUMENTS

| | | | |
|---|---|---|---|
| 1243950 | 2/1964 | Fed. Rep. of Germany . | |
| 1281381 | 10/1968 | Fed. Rep. of Germany | 72/403 |
| 1915656 | 2/1970 | Fed. Rep. of Germany | 72/402 |
| 2204038 | 8/1973 | Fed. Rep. of Germany | 403/370 |
| 2527088 | 1/1977 | Fed. Rep. of Germany | 72/449 |
| 2034861 | 6/1980 | United Kingdom | 403/371 |
| 2069660 | 8/1981 | United Kingdom | 403/368 |
| 174930 | 11/1965 | U.S.S.R. . | |
| 695756 | 11/1979 | U.S.S.R. . | |
| 700258 | 12/1979 | U.S.S.R. . | |

*Primary Examiner*—Allan D. Herrmann
*Assistant Examiner*—D. Wright
*Attorney, Agent, or Firm*—Fleit, Jacobson, Cohn & Price

[57] ABSTRACT

The gear drive is suitable for use in forging machines having a number of dies arranged around the workpiece.

The gear drive consists of drive shafts (23), lay shafts (13) and driven shafts (10) which are located in a circle concentric with the axis of the forging machine and are interlinked by means of gears (6), (11) attached to shafts. The driven shafts (10) impart motion to the tools, i.e. to the dies of the machine.

The driven shafts (10) with the gears (6) attached thereto are located in a circle of a relatively bigger diameter (D). The lay shafts (13) with the gears (11) attached thereto are located in a circle of a relatively smaller diameter (d). The circles of the bigger and smaller diameters (D, d) are concentric with the axis of the forging machine. The gears (6) of the driven shafts (10) are movably interlinked with the gears (11) of the lay shafts (13).

The gears (6) and (11) of the driven shafts (10) and the lay shafts (13) are arranged in the same plane.

The gears (6) are attached to the driven shafts (10), each by a keyless joint (18), (19), (20) and (21).

3 Claims, 4 Drawing Figures

GEAR DRIVE OF FORGING MACHINE

TECHNICAL FIELD

The present invention relates to machinery for plastic working of metals, for example, by pressworking or press forging and has specific reference to a gear drive of a forging machine having a number of dies located around the workpiece.

BACKGROUND ART

One of the main demands of modern manufacture which should be satisfied by machines for plastic working, forging machines included, is an ever-increasing production rate. There are known a number of methods of boosting the production rate but regarded as the principal one is the speeding up of dies. Giving extra speed to dies, i.e. increasing the rate of deformation of the workpiece is also a requirement arising in connection with the working of high-alloy steels and alloys deformable with difficulty which gain ground in mechanical engineering, especially in such its fields as aviation, rocket propulsion and the like.

At present, the working speed of the dies of machines for plastic working is decided by a number of factors among which is the circumferential speed of the gears and pinions forming the drive of said machines. In the known forging machines, the rotary motion of the electric motor and drive shaft is transmitted to driven shafts through lay shafts with gears attached thereto. The driven shafts of the eccentric type transform the rotary motion of the drive into a reciprocating or swinging motion of the die. The lay and driven shafts are located in the known machines all the way along the circumference of a circle of a certain diameter and are movably interlinked by means of gears which are attached to these shafts and form a circular train (cf. for example, Pat. No. 1,243,950, B21j of the Federal Republic of Germany). In this drive, the driven shafts are spaced equidistantly apart along the circumference of a circle. In forging machines with four dies, widely used in forge and blanking shops, the driven shafts form a square. As a result, the drive is bulky, occupying a significant floor area in the shop.

In high-speed machines such as, for example, those of the GFM make, Austria, according to Pat. No. 1,243,950 B21j of the Federal Republic of Germany, the circumferential speed of the gears is not over $V=\omega R$ 20 m/s, where $\omega=\pi n/30\ s^{-1}$ in which n are the revolutions of the driven shaft per minute and R is the radius of the gear in m.

The fact that in the known forging machines the lay and driven shafts are located in a circle of the same diameter, being spaced equidistantly apart, gives rise to circumferential speeds of a magnitude which cannot be endured by the gears of the drive cut by any known method. There is also no way of reducing the resulting vibration and noise to a level consistent with sanitary regulations.

To ensure synchronous operation of all dies, provided the distance between them can be adjusted directly during the forging operation, as this is the case in modern forging machine, the machine according to Pat. No. 1,243,950 of the Federal Republic of Germany employs double slider (Oldham) couplings which link the gears to the driven shafts. The gears of the lay and driven shafts are accommodated in a separate housing. The drive flanges of each Oldham coupling are rigidly attached to the gears and the driven flanges are rigidly attached to flywheels, the gears and flywheels being located in different planes and accommodated in separate housings. The sequence of assembling the gear drive and driven shafts of said forging machines is determined by the design of the machine but, to ensure synchronous operation of the dies, it is necessary to preassemble the gear drive, the Oldham couplings and the driven shafts. On completing said preassembling, keyways are cut in the driven shafts and flywheels in accordance with the marking applied to indicate the position ensuring synchronous operation of the dies.

Said labour-consuming process catering for synchronism of the dies must be repeated each time a driven shaft or flywheel must be renewed due to damage or some other reason which may occur during the period of operation of the machine.

Thus, the gear drive of the forging machine in accordance with Pat. No. 1,243,950 of the Federal Republic of Germany has the following features:

the lay and driven shafts and their gears are located in circles of the same diameter; consequently, the machine is of significant dimensions in plan and the circumferential speed of the gears is excessively high;

synchronous operation of the dies is ensured by means of double slider (Oldham) couplings and a rigid attachment of the flywheels and driven shafts by keys, the gear drive being preassembled and the keyways marked off to that end;

the gears and flywheels are located in different planes, said their position being attributed to the peculiarities of the construction of the machine and its gear drive referred to hereinabove.

SUMMARY OF THE INVENTION

The main object of the present invention is to provide a gear drive of forging machine wherein the gears are located so that their circumferential speed is significantly reduced whereas the revolutions of the driven shafts and, consequently, the production rate of the machine are appreciably increased.

Said object is realized by the fact that in a gear drive with parallel drive shafts, lay shafts and driven shafts which are interlinked by means of gears fitted thereto and arranged in a circle coaxial with the axis of forging, in accordance with the invention, the driven shafts and the lay shafts are arranged in two concentric circles of a bigger and a smaller diameter, respectively, the gears of the lay shafts forming a circular train wherein between the adjacent shafts there is contained the same number or gears.

Should the gears of the lay shafts of the known gear drive and those of the disclosed one rotate at the same angular velocities $\omega_\sigma=\omega_s$, respectively, the driven shafts of the disclosed drive will significantly gain in speed, for its gears arranged in the circle of the smaller diameter have an appreciably reduced radius. This is feasible to achieve because of the circumferential speed $V_s$ of the gears of the disclosed drive being significantly lower of the circumferential speed $V_\sigma$ of the known drive:

$$V_s=\omega_s R_s<V_\sigma=\omega_\sigma R$$

$$\omega_s=\omega_\sigma$$

$$R_s(d)<R_\sigma(d')$$

Moreover, the arrangement of the gears of the lay and driven shafts of the drive in two circles in conducive to compactness of the drive achieved, for example, by bringing the driven shafts closer to one another in the horizontal and spacing them wider apart in the vertical. This will significantly reduce the dimensions of the drive in plan.

In accordance with an embodiment of the invention, the gears of all shafts of the drive are located in the same plane.

Paving the way to said feature of design is the fact that the gears of the drive and lay shafts are arranged at the circumferences of two circles, for it is possible to combine a driven shaft gear, in the form of a gear ring, with the flywheel rigidly attached to the driven shaft. Consequently, the forging mechanism and the gear drive can be accommodated in the same housing. This simplifies the problem of casting the housing, improves its dependability and extends the service life.

It is expedient that each gear is attached to the respective driven shaft by means of a keyless joint.

Keyless joints between the gears and their shafts will simplify the installation and taking down of the gear drive ensuring synchronous operation of the dies at the same time.

BRIEF DESCRIPTION OF THE DRAWINGS

Other objects and advantages of the present invention will be best understood from the following description thereof by way of an example of the preferred embodiment thereof when this description is being read in conjunction with the accompanying drawings in which.

DESCRIPTION OF THE PREFERRED EMBODIMENT OF THE INVENTION

Figure 1:
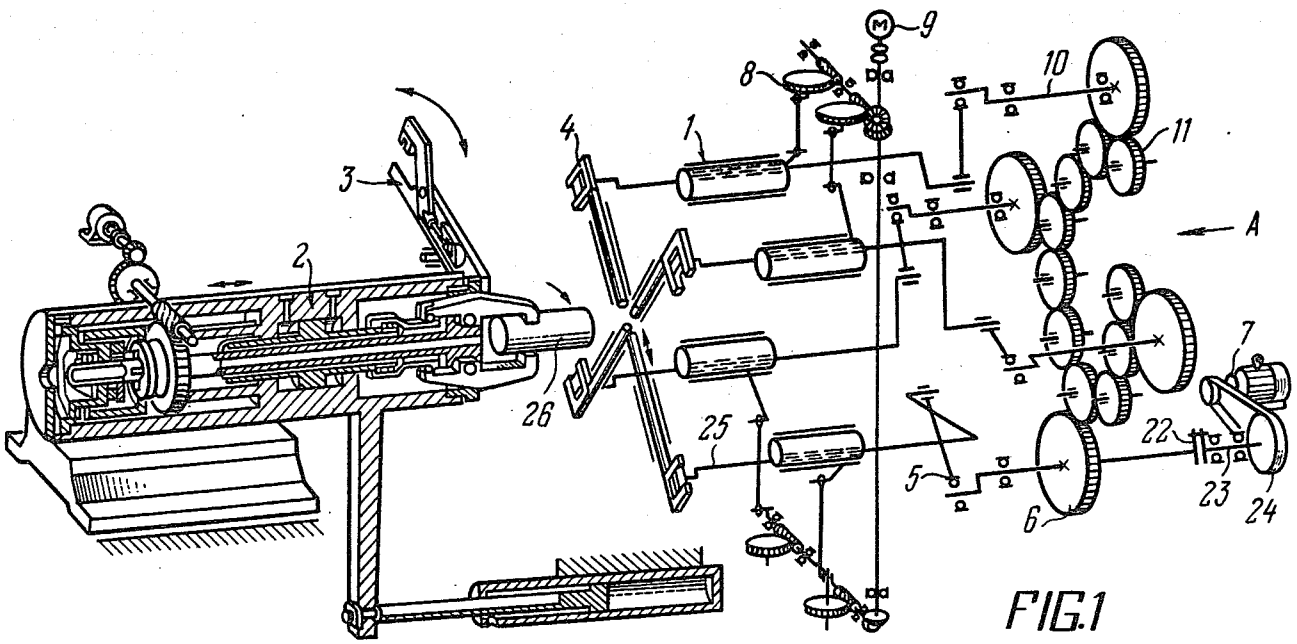
FIG. 1 is a schematic layout of the gear drive of forging machine in accordance with the invention.

Referring to FIG. 1, the forging machine used wherein is the disclosed gear drive is of a known construction. It essentially consists of two groups of mechanisms shown at 1 and 2 which are the forging mechanisms and a mechanical manipulator, respectively, said manipulator being used to hold and handle the workpiece in the course of forging and operating in conjunction with a means 3 of feeding the workpiece thereinto and removing same therefrom.

Each forging mechanism comprises a block linkage mechanism 4 which actuates the dies, a crank mechanism 5 transforming the rotary motion transmitted from a source 7 of motion and power by way of a gear drive 6, and a means 8 of adjusting the distance between the dies with a source 9 of motion and power of its own. It is preferred to use an electric motor 7 as the source of power in the forging mechanism and a hydraulic motor 9 in the means of adjusting the position of the dies with respect to the axis of forging.

Figure 2:
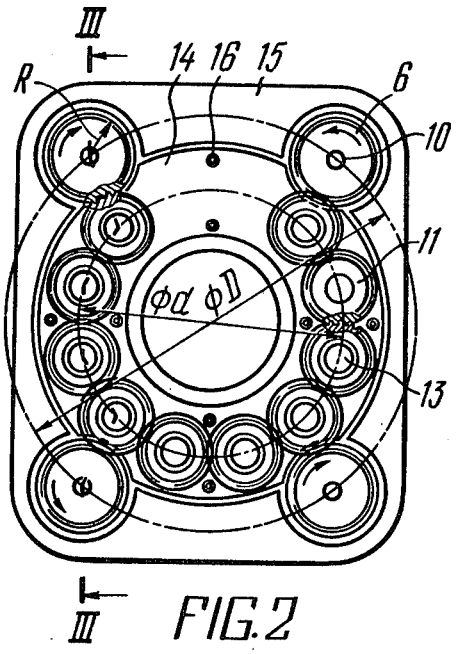
FIG. 2 is a view in the direction of arrow A in FIG. 1.

A part and parcel of the block linkage mechanism are four dies rigidly attached to crank blocks 4. Said number of dies is decided by the number of the crank mechanisms 5 and the driven shafts 10 attached whereto are the gears of the drive 6. If used is another number of dies, there will be a corresponding number of driven shafts 10 with the gears 6 but the design principle of the drive will not change. Referring to FIG. 2, the gears 6 with the driven shafts 10 are arranged along the circumference of a circle with a diameter D so that the gears 11 of the lay shafts are located along the circumference of circle of a smaller diameter d, forming a circular train. The circumference of the circles with the diameters D and d are concentric. Each of the driven shafts 10 is set into motion by the same number of the gears 11 of the lay shafts irrespectively of the distance between the adjacent driven shafts 10.

Figure 3:
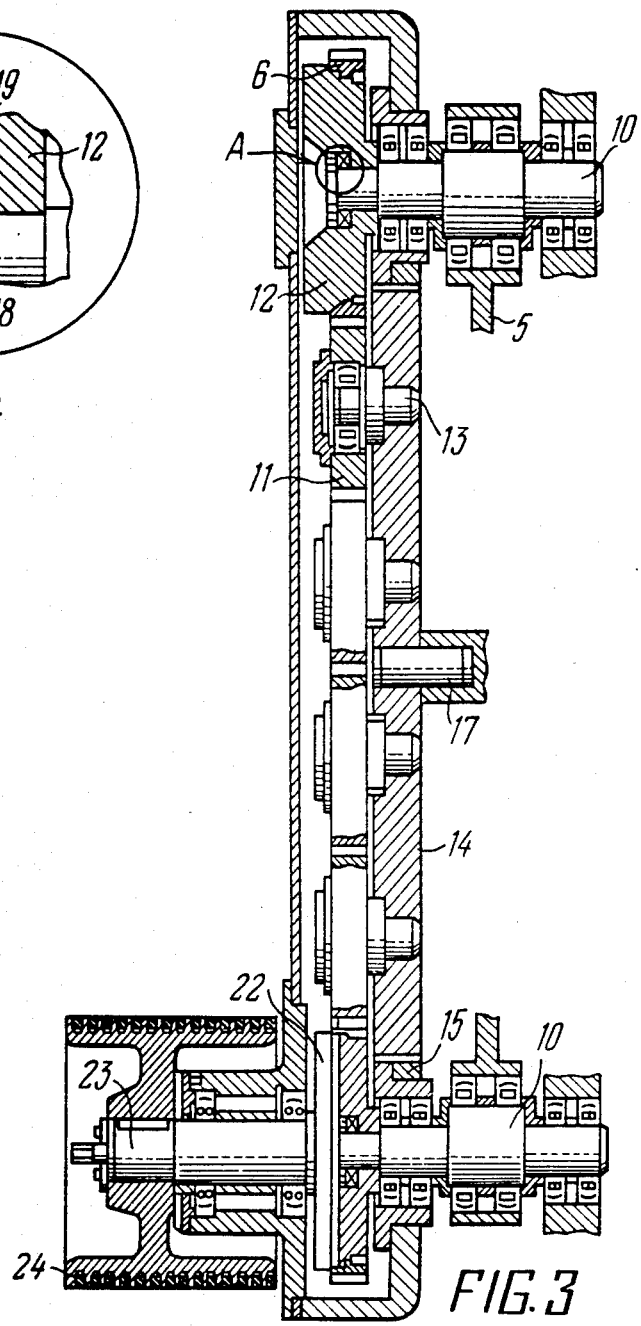
FIG. 3 is a section on line III—III of FIG. 2.

The gears 6 are press-fitted to flywheels 12 so as to be in the same plane with the gears 11 of the lay shafts (FIG. 3). The gears 11 are fitted to fulcrum pins 13 by means of rolling contact bearing, and the pins 13 are press-fitted into a disc 14 which is attached to a frame 15 of the forging mechanism by screws 16 and pins 17.

Figure 4:
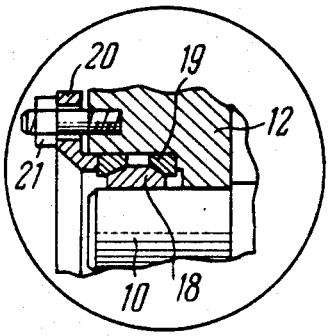
FIG. 4 is a view showing details of the keyless joint between a flywheel and the driven shaft in accordance with an embodiment of the invention.

The flywheels 12 are attached to the driven shafts 10 by a keyless joint (FIG. 4). Said joint consists of two rings 18, 19 and a collar flange 20. The ring 18, a sliding fit on the driven shaft 10, is of a trapeziform cross section. The rings 19, each a sliding fit into the flywheel 12, are chamfered at their inside edges, and the chamfers contact the ring 18. A tightening of nuts 21 located all the way around the circumference of the rings 19 causes the collar of the flange 20 to deform the mating tapered surfaces of the rings 19 and 18. As a result, the rings 19 become tensioned and the ring 18 is compressed in the diametrical direction. Being thus seized between the shaft 10 and the flywheel 12, the rings 18, 19 facilitate the transmission of the torque from the gear 6 and flywheel 12 to the shaft 10 without slippage at their mating taper surfaces. Once the nuts 21 have been undone and the interference between the rings 18 and 19 eliminated, the flywheel 12 can be easily turned with respect to the shaft 10 or taken down at all.

Said way of fixing the flywheels 12 to the shafts 10 is conductive to adjusting the dies for synchronous operation with ease, rendering superfluous the preassembling and marking off of the gears, flywheels and driven shafts. The synchronization of the dies by tightening the keyless joints also permits the replacement of any member of the forging mechanism without any preassembling and adjustment with respect to the rest of members. This simplifies the erection of the machine and saves labour required for its manufacture and operation.

One of the driven shafts 10 is rigidly linked to a drive shaft 23 by a coupling 22 and said drive shaft is connected to the electric motor 7 through a V-belt drive 24. The drive shaft 23, the lay shafts 13 and the driven shafts 10,25 are parallel to one another and to the axis of forging.

The forging machine and the disclosed gear drive operate on the following lines. The rotary motion of the electric motor 7 is transmitted to the flywheel 12 through the V-belt drive 24, the drive shaft 23 and the coupling 22. Said flywheel 12 sets into motion the rest of the flywheels 12, all at a time, by means of the gears 6 and the gears 11 of the lay shafts and these fly-wheels impart rotary motion to the shafts 10, being connected thereto with the keyless joints 18, 19, 20 and 21. The shafts 10 are the eccentric shafts of the crank mechanism 5 which transforms the rotary motion into a swinging motion of the eccentric shaft 25. This latter shaft induces a reciprocating motion of the crank blocks 4 of the forging mechanism 1 and, consequently, of the dies which are attached to the crank blocks 4. The workpiece 26 gripped by the manipulator 2 is introduced into the dies the distance between which has been set in advance, by means of the mechanism 8 actuated by the hydraulic motor 9, in accordance with specified dimensions of the product. On being worked so as to obtain the specified diameter and length, the workpiece is withdrawn from the dies. This completes the working cycle, the next workpiece being then worked in the same way.

For an adjustment of the dies for synchronous operation, the nuts 21 are undone, enabling the flywheels 12 to be turned about the shafts 10 integrally with the gears 6. Next, the shafts 10 are turned through an angle bringing the bearing surfaces of the crank block 4 (with the dies removed) into a tight contact with an adjusting pin. The tightening of the nuts 21 of the keyless joints at all flanges 20 completes the adjustment, the machine being fit for operation on returning the dies into their places.

INDUSTRIAL APPLICABILITY

The present invention may be used to advantage in forging machines having a number of movable die sets arranged equidistantly apart around a workpiece and operating synchronously as this is the case in automatic forging machines of the rotary type. The invention may also find application in machines the die sets of which, although arranged in a circle, are spaced in a nonuniform way as, for example, in automatic punching presses and automatic plate bending machines, etc.

The invention can also be used in other branches of mechanical engineering to impart motion to a number of tools arranged in a circle which is oriented in some way with respect to a common axis of working.

We claim:

1. A gear drive of forging machine having parallel drive shafts, lay shafts and driven shafts located in a circle concentric with the axis of forging and interlinked by means of gears attached thereto, characterized in that the driven shafts (10) and the lay shafts (13) are located in two concentric circles, the former in a circle of a relatively bigger diameter (D) and the latter in a circle of a relatively smaller diameter (d), the gears (11) of the lay shafts (13) forming a circular train contained wherein between the adjacent driven shafts (10) there is the same number of the gears (11).

2. A gear drive of forging machine as claimed in claim 1, characterized in that the gears (6), (11) of the shafts (10) and (13) are located in the same plane.

3. A gear drive of forging machine as claimed in claim 1, characterized in that each gear (6) is attached to its driven shaft (10) by means of a keyless joint (18), (19), (20) and (21).

* * * * *